US006923187B2

(12) United States Patent
Montoli et al.

(10) Patent No.: US 6,923,187 B2
(45) Date of Patent: Aug. 2, 2005

(54) MASCARA BRUSH WITH Z-SHAPED BRISTLE FIBERS

(75) Inventors: Antonio Montoli, Brookfield, CT (US); Raymond P. LeGassie, Laconia, NH (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 278 days.

(21) Appl. No.: 10/134,826

(22) Filed: Apr. 29, 2002

(65) Prior Publication Data

US 2003/0150076 A1 Aug. 14, 2003

Related U.S. Application Data

(63) Continuation-in-part of application No. 10/075,736, filed on Feb. 14, 2002, now Pat. No. 6,810,885.

(51) Int. Cl.[7] ..... A45D 40/26; A46B 3/18

(52) U.S. Cl. ..... 132/218; 132/320; 15/206; 15/207.2; 428/397

(58) Field of Search ..... 15/206, 207.2; 132/218, 320; 428/397, 398

(56) References Cited

U.S. PATENT DOCUMENTS 3,121,040 A * 2/1964 Shaw et al. ..... 264/209.1
3,383,276 A * 5/1968 Gould ..... 428/397
4,559,268 A * 12/1985 Nakashima et al. ..... 428/397
4,733,425 A 3/1988 Hartel et al. ..... 15/206
4,887,622 A * 12/1989 Gueret ..... 132/320
4,927,281 A 5/1990 Gueret ..... 401/129
5,063,947 A 11/1991 Gueret ..... 132/218
5,567,072 A 10/1996 Dunleavy et al. ..... 401/129
5,762,432 A 6/1998 Dunleavy et al. ..... 401/129
6,012,465 A 1/2000 Gueret ..... 132/218
6,073,634 A * 6/2000 Gueret ..... 132/218
6,280,113 B1 * 8/2001 Gueret ..... 401/122
6,390,708 B1 * 5/2002 Gueret ..... 401/122
6,481,445 B1 * 11/2002 Miraglia ..... 132/218
6,669,389 B2 * 12/2003 Gueret ..... 401/122

FOREIGN PATENT DOCUMENTS

WO 02/03832 * 1/2002

* cited by examiner

*Primary Examiner*—Mark Spisich
(74) *Attorney, Agent, or Firm*—St. Onge Steward Johnston & Reens LLC

(57) ABSTRACT

An improved mascara brush has a typical twisted wire core containing bristles of Z-Shaped cross-section. The Z-shaped cross-section may be a conventional Z-shape; or it may be square or rectangular thereby defining a cross-section of discontinuous square, diamond or polygon shape with a connecting web; or it may be circular or oval thereby defining a cross-section of discontinuous circular shape with a connecting web. In either embodiment the cross-sectional shape effectively creates two longitudinal voids extending along the length of the bristle.

16 Claims, 1 Drawing Sheet

MASCARA BRUSH WITH Z-SHAPED BRISTLE FIBERS

CROSS-REFERENCE TO RELATED APPLICATIONS

The present application is a continuation in part of U.S. patent application Ser. No. 10/075,736, filed Feb. 14, 2002, U.S. Pat. No. 6,810,885, and entitled "Mascara Brush with High Durometer Fibers."

FIELD OF THE INVENTION

The present invention relates to a brush for applying cosmetic products, in particular, mascara, to eyelashes.

BACKGROUND OF THE INVENTION

Twisted wire brushes for application of liquid-type cosmetics, such as for application of mascara to the eyelashes, are well known in the art. The brushes are designed to pick up and hold a supply of mascara from the cosmetic container, and then deliver the mascara to the eyelashes as the brush is combed through the lashes by the user.

Twisted wire brushes conventionally are manufactured by disposing a plurality of individual lengths of bristles transverse to and between substantially parallel, slightly spaced-apart thin metal wire lengths, such that the wire lengths generally bisect the filament lengths at their midpoints. Most typically, the parallel wire lengths comprise the two substantially equal leg lengths formed from bending a single length of wire into a U-shaped configuration. The wire lengths are then twisted together to form a helical core, causing the bristles disposed between the wires to be clamped therebetween at about their midpoints. In the twisting and clamping, the segments of the bristles on either side of the clamped midpoint are caused to flare radially outward from the core and so form an elongate bristle brush portion of generally circular cross-section. The brush is generally provided with a handle which can comprise, or be affixed to, a cap or other closure for the cosmetic container.

It is known in the art that this helical wire twisting method for forming cosmetic applicator brushes typically leads to a brush configuration in which the bristles tend generally to follow the helical pattern of the twisted wire core, i.e., whereby the tips of the bristles define a helix. The degree of axial spacing between turns of the helix varies depending on the number, type and thickness of bristles employed, the wire thickness employed, the number of helical twists used in forming the wire core, and other like factors. See, for example, U.S. Pat. No. 4,887,622 to Gueret, and U.S. Pat. No. 4,733,425 to Hartel et al.

The bristles are usually comprised of nylon filaments. The bristles serve the function of collecting mascara from a reservoir and holding the mascara until it is applied to the user's eyelashes. Standard mascara brush designs of the 1960s and 1970s used smaller diameter bristles in fairly large numbers of bristles per turn.

The state of the art then evolved to a somewhat larger diameter bristle, as defined in U.S. Pat. No. 4,887,622 entitled "Brush for the Application of Mascara to the Eyelashes." The patent discloses a mascara brush having a reduced number of bristles, said to be 35% to 80% less than in conventional mascara brushes, ostensibly of larger diameter, than the bristles employed in conventional mascara brushes at the time. This was believed to provide a better application of mascara and separation of lashes. The patent specifies mascara brushes having a bristle diameter from about 0.10 to 0.25 mm (e.g. about 0.004 to 0.010 inch) (4 mil to 10 mil) and with from approximately 10 to 40 bristles per turn of the helix.

The concept of a mascara brush having larger diameter bristle fibers was further discussed in a recent PCT application No. PCT/US01/04555. This application is directed towards mascara brushes made from filaments that are relatively large but soft. Specifically, the application describes mascara brushes having preferably having 7–14 bristles per turn. The bristle filaments are defined as preferably being from 0.010 inch to 0.013 inch (10 mil to 13 mil). Most critically, the bristles are defined as being relatively soft being made of a thermoplastic elastomer having a durometer of between 62 Shore D and 82 Shore D, but most preferably about 72 Shore D. PCT application PCT/US01/04555 essentially defines a mascara brush made with a duPont Filaments filament sold under the trademark "Supersoft." The "Supersoft" filaments have a durometer of 72 Shore D and are available as solid filaments or as triocular filaments having three hollow voids.

Mascara, which is typically highly viscous, tends to clump when applied to eyelashes. The clumps of mascara are typically combed out as a finishing step to the application process. Stiffer bristles are thought to be better suited for combing out clumps and properly separating lashes. However, the combing and separating functions are thought to be better accomplished with brushes a having relatively open bristle envelope or brush surface, i.e., an envelope or surface that has numerous or wide clearances or spaces between bristles to make the brushes more 'comb-like'. This function is not well served by traditional mascara brush designs having smaller diameter bristles with higher bristle density.

A mascara brush with softer, more numerous bristles has been generally thought to be well suited for applying mascara but less well suited for combing out clumps and separating lashes. Conversely, a brush with stiffer, fewer bristles has been thought to be well suited for combing and separating lashes but less well suited for applying mascara to lashes. While a separate brush can be used for each function, i.e., a soft brush for application and a stiff brush for combing, a single brush that can both apply mascara and comb out clumps would be preferred for the convenience of the user.

An example of a brush that is said to provide good application and combing characteristics is shown in U.S. Pat. No. 4,861,179 to Schrepf et al., which discloses a brush having a combination of conventional soft bristles and conventional stiff bristles.

Another example of a brush said to provide good application and combing characteristics is shown in U.S. Pat. No. 5,238,011 to Gueret. The Gueret patent discloses bristles made of a soft material having a shore hardness of 20 A to 40 D (as noted above, a conventional bristle typically has a durometer of over 85 D), and a large diameter in a range of 0.004 inch to 0.014 inch (4 to 14 mil) (0.10 to 0.35 millimeter). As disclosed by Gueret, the diameter is said to be sufficiently large to prevent too high a degree of suppleness. The resulting brush is said to have the same degree of suppleness or softness as a conventional softer brush. Accordingly, the bristles are equivalent in stiffness to conventional bristles.

While the forgoing brushes may be suitable for the application and combing of mascara in use at the time, many mascara formulations have significantly higher viscosity.

Higher viscosity mascaras tend to collapse softer durometer bristles, so they are not effective for their intended use.

Thus, there is a need for a brush that can apply mascara from a bottle to the user's eyelashes, uniformly and in desired amounts, and comb out any undesired excess while separating eyelashes, and which is suited for modern mascara formulations.

SUMMARY OF THE INVENTION

An improved mascara brush has a typical twisted wire core containing bristles having a Z-Shaped cross-section, preferably, of a relatively large diameter, most preferably, also having a high durometer.

The bristles are generally Z-shaped in cross-section, either square, rectangular, circular or oval, with a dividing web across the midpoint of the bristle, and having a discontinuous outer wall thereby defining a cross-section of discontinuous circular shape or a discontinuous square or diamond shape, thus effectively creating two longitudinal voids extending along the length of the bristle.

The mascara brush may be implemented in accordance with specified bristle diameter and bristle density parameters of three different embodiments suitable for different mascara formulations.

DETAILED DESCRIPTION OF THE DRAWINGS

Figure 1:
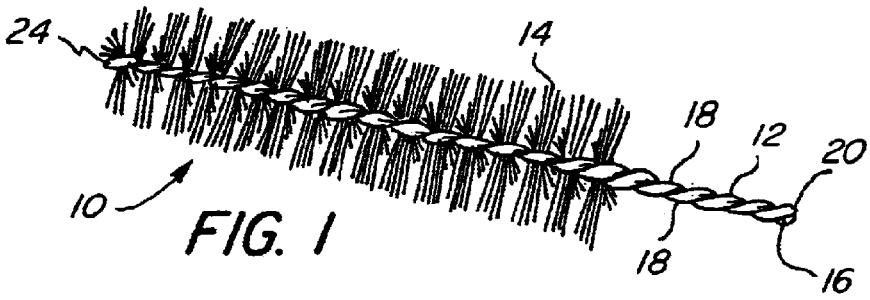
FIG. 1 is a side elevation view of a mascara brush in accordance with the invention.

Referring now to FIG. 1, a mascara applicator brush, designated generally by reference numeral 10, is shown. The brush is intended for use in a typical mascara bottle (not shown) with an opening into which the brush 10 is inserted.

The brush 10 is comprised of a central twisted wire core 12 containing bristles 14. The core 12 is a twisted wire core typically made by forming a soft metal wire 16 into a "U" shape. A plurality of bristles 14 are placed between the segments 18 of wire 16. The wire segments 18 are then twisted about the longitudinal axis to clamp bristles 14 at approximately a midpoints of the bristles 14. The bristle ends extend radially from the twisted wire core 12. Core 12 has a lower end 20 connected to a shaft, and an upper end 24 opposite the lower end 20. The lower end 20 of the core 12 is connected to a handle by way of the shaft, however, the lower end 20 of the core 12 could alternatively be attached to another structure such as a bottle cap. After the bristles 14 are mounted to the wire core 12 the brush 10 can be trimmed to have any desired shape, for example, cylindrical, tapered, conical, curved, etc.

Figure 2:
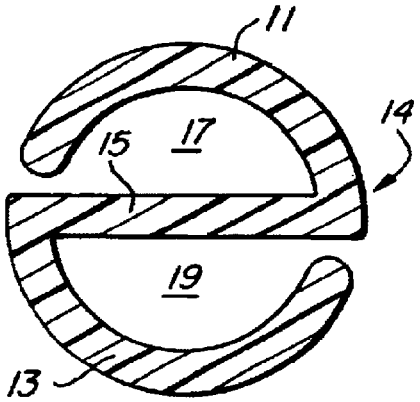
FIG. 2 is a cross-sectional view of one version of a bristle of Z-shaped cross-section.
Figure 3:
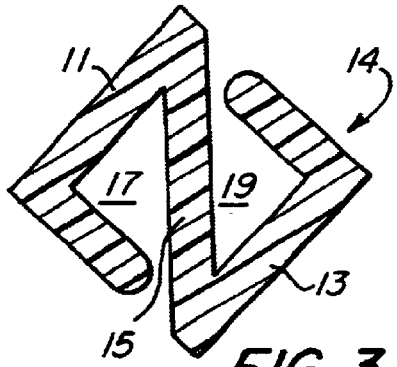
FIG. 3 is a cross-sectional view of a second version of a bristle of Z-shaped cross-section.
Figure 4:
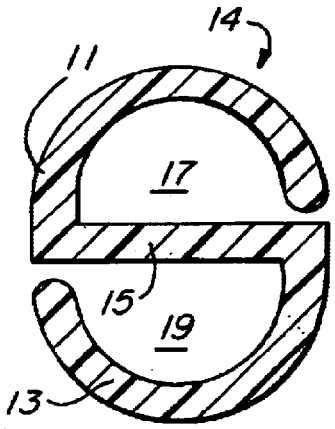
FIG. 4 is a cross-sectional view of a third version of a bristle of Z-shaped cross-section.
Figure 5:
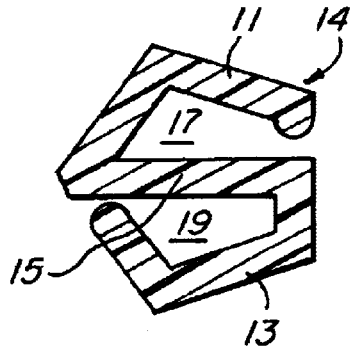
FIG. 5 is a cross-sectional view of a fourth version of a bristle of Z-shaped cross-section.

Referring now to FIGS. 2–5, the bristles 14 (or the filament from which they are made) are Z-shaped in cross-section. The bristles thereby typically have an upper wall 11 and a lower wall 13 connected by a longitudinal web 15. The walls 11 and 13, and the web 15 together define the interior of the bristles as longitudinal voids 17 and 19. The two longitudinal voids 17, 19 extend through at least a substantial portion of bristles 14. The Z-shaped bristles may have a variety of embodiments, ranging from an embodiment where upper wall 11 and lower wall 13 are curved as shown in FIGS. 2 and 4, which respectively define a discontinuous circle with a central web and a discontinuous oval with a central web; or an embodiment where upper wall 11 and lower wall 13 are flat and define a discontinuous polygonal shape as shown in FIGS. 3 and 5, which respectively show a discontinuous square or diamond with a central web, and a discontinuous pentagon with a central web; and the polygon could of course take other polygonal shapes such as rectangular, or hexagonal shapes with a central web. The Z-shaped cross-sectional shape claimed in this application defines bristles which have upper and lower walls 11 and 13 connected by a longitudinal web 15 dividing the interior of the bristles into two longitudinal voids 17 and 19. These voids, as can be seen in FIGS. 2–5, are enclosed by the surrounding walls 11 and 13 and web 15, and only a narrow gap is provided between the end of the upper and lower walls 11 and 13 and the web 15 to form the discontinuous enclosed cross-sectional shape. It should be noted that the appearance of the Z-shaped cross-section depends on the point of reference: a filament viewed from one end will appear as a conventional "Z" in cross-section, but viewed from the opposite end will appear as a reversed "Z". In the Figures, FIGS. 2–3 show a conventionally oriented "Z", and FIGS. 4–5 show a reversed "Z." Both orientations fall within the intended scope of the claims.

The bristle filaments are nylon filament, polyester filament, or another suitable material manufactured by extrusion through the appropriate die. It should be noted that the upper wall 11 connects to the web 15, and the web 15 connects to the lower wall 13, all without any thinning of the filament at these connections. In other words, unlike the filaments disclosed in U.S. Pat. No. 6,012,465, there are no areas of intended deformation, which, if present, would be inconsistent with the overall design of the present mascara brush.

Bristles 14 are typically made by cutting short segments from spools of filaments. In the making of the filaments used to manufacture of the bristles, there may be manufacturing variations where some portions of the filaments, and thus parts of the bristles, lack the dual voids, but the inventions claimed herein shall include all brushes made with such filaments even if individual bristles in the brush may lack continuous dual voids along their entire length. The voids may extend through the cross-section continuously along the length of each bristle fiber, or may be provided in the cross-section at spaced intervals along the length of each bristle fiber. As seen in the drawings, the narrow gap between the free ends of the wall portions (11,13) and the web (15) is small and is generally less than the wall thickness of the web (15) and wall portions (11,13).

In one embodiment of the invention, the bristles preferably have a diameter of from 0.010 inch to about 0.016 inch (10 mil to 16 mil). More preferably, in this embodiment, the diameter of the bristles will be 0.011 inch to 0.013 inch. As noted, the filaments can have either circular shapes or polygonal shapes, thus, the term "diameter" as used herein is intended to mean the maximum distance between any of the possible opposite positions on the outer surface of a bristle filament. In this first embodiment, the bristle density is in the range of 8 to 20 bristles per turn; more preferably 10–15 bristles per turn, and most preferably 12–14 bristles per turn. The filaments from which the bristles are made are preferably selected for having a specific hardness, preferably, a durometer in the range of about 92 Shore D hardness to 120 Rockwell R; more preferably about 100 to 120 Rockwell R; most preferably about 103 to 108 Rockwell R.

The number of bristles per turn can be determined by several methods. One method involves counting bristle ends in one 360 degree turn of the brush and dividing by two to arrive at a count of bristles per turn. Another method involves counting the total number of 360 degree turns of the bristles of the brush along the length of the brush, then counting the total number of bristles, and diving the total bristle count by the total turn count, to determine an average of bristles per turn. It is contemplated that in a basic brush, there will be a substantially constant bristle density along the length of the brush, with a small variations depending on manufacturing precision. However, it is also possible that the bristle densities are an average bristle density, with greater variation in the bristle density between different zones (such as the ends versus the middle zones of the brush). As used herein, "bristle density" encompasses both definitions.

The voids of the bristles 14, provided in combination with the larger diameter and the harder durometer of the bristles 14 described in the above embodiment, used in a brush with fairly low bristle counts, yields a brush that is excellent in fast and effective application of mascara to the eyelashes, with good ability to lift and comb the lashes, and uniform coating of mascara on eyelashes. Although useful with any conventional mascara, the improved brushes made with bristles according to the fore-going disclosure are particularly important when used with higher viscosity, faster setting mascara formulas. The larger, harder bristles provide a mascara brush capable of applying modern mascara formulas in sufficient volumes and combing out excess without the disadvantage of bristles collapsing, but the specific Z-shaped filament provides a desirable element of flexibility to the brush.

In a second embodiment of the invention, the filaments from which the bristles are made have a different diameter size range, which is preferably from about 0.004 inch to about 0.0099 inch (about 4 mil to about 9.9 mil). More preferably, the bristles have a diameter from about 0.004 inch to about 0.006 inch (about 4 mil to about 6 mil). Most preferably, in this embodiment, the diameter of the bristles will be about 0.005 inch. In this embodiment, the bristle density is in the range of 10 to 40 bristles per turn; more preferably 15–30 bristles per turn. The bristle hardness in such case will be similar to the first embodiment, e.g. a durometer in the range of about 92 Shore D hardness to 120 Rockwell R; more preferably about 100 to 120 Rockwell R; most preferably about 103 to 108 Rockwell R. However, it is also possible to use a higher bristle density, in the range of 40–60 bristles per turn, with, potentially, a softer bristle filament.

The Z-shaped bristles 14 in the size range of the second embodiment, used in a brush with the specified bristle counts, yields a brush that provides good application of mascara to the eyelashes, again with good ability to lift and comb the lashes, particularly for masacara formulations of moderate viscosity.

In a third embodiment of the invention, the filaments from which the bristles are made have a smallest diameter size range, which is preferably from about 0.001 inch to about 0.0039 inch (about 1 mil to about 3.9 mil). Most preferably, in this embodiment, the diameter of the bristles will be about 0.002 to about 0.003 inch. In this embodiment, the bristle density is in the range of 18 to 150 bristles per turn; more preferably 40 to 60 bristles per turn. The bristle hardness in such case will be similar to the second embodiment, e.g. a durometer in the range of about 92 Shore D hardness to 120 Rockwell R; more preferably about 100 to 120 Rockwell R; most preferably about 103 to 108 Rockwell R.

However, it should be noted that the Z-shaped bristles of the invention can be made from filaments having lesser hardness than the 92 Shore D hardness at the lower end of the hardness range, and that such selection may be made consistent with the commercial and esthetic requirements for the product.

The Z-shaped bristles 14 in the size range of the third embodiment, used in a brush with the specified bristle counts, yields a brush that provides good application of mascara to the eyelashes, again with good ability to lift and comb the lashes, particularly for masacara formulations of low viscosity.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A brush for applying mascara to eyelashes, comprising:

a twisted wire core holding a plurality of radially extending bristles to form a brush at an end of the core, said bristles being substantially hollow and having a Z-shaped cross-sectional shape forming a discontinuous enclosed cross-sectional shape defined by upper and lower walls connected to a longitudinal web dividing an interior of said bristles into two longitudinal voids, said longitudinal voids extending through at least a substantial portion of said bristles, said upper and lower walls extending away from and back to said longitudinal web whereby said two longitudinal voids are substantially enclosed except for narrow slots which provide communication between an enclosed interior of each longitudinal void of said bristles and an exterior of said bristles, said upper and lower walls and the web having a substantially constant wall thickness with no reduction in thickness in the region of connection between the web and the upper and lower walls, free ends of the walls being spaced from the web to define the narrow slots, and the spacing being generally less than the wall thickness.

2. A brush in accordance with claim 1, wherein said upper and lower walls of said bristle cross-sectional shape are curved.

3. A brush in accordance with claim 2, wherein said bristle cross-sectional shape is a discontinuous circle or oval.

4. A brush in accordance with claim 1, wherein said bristle cross-sectional shape is a discontinuous square or polygon.

5. A brush in accordance with claim 1, wherein said bristles have a diameter of between about 0.010 inch to about 0.016 inch.

6. A brush in accordance with claim 5, said bristles being provided at a bristle density of between about 8 to about 20 bristles per turn.

7. A brush in accordance with claim 1, wherein said bristles have a diameter of between about 0.004 inch to about 0.0099 inch.

8. A brush in accordance with claim 7, wherein said bristles have a diameter of about 0.004 inch to about 0.006 inch.

9. A brush in accordance with claim 7, said bristles being provided at a bristle density of between about 10 to about 40 bristles per turn.

10. A brush in accordance with claim 9, said bristles being provided at a bristle density of between about 15 to about 30 bristles per turn.

11. A brush in accordance with claim 8, said bristles being provided at a bristle density of between about 40 to 60 bristles per turn.

12. A brush in accordance with claim 1, wherein said bristles have a diameter of between about 0.001 inch to about 0.0039 inch.

13. A brush in accordance with claim 12, wherein said bristles have a diameter of about 0.002 to about 0.003 inch.

14. A brush in accordance with claims 12, said bristles being provided at a bristle density of between about 18 to about 150 bristles per turn.

15. A brush in accordance with claim 14, said bristles being provided at a bristle density of between about 40 to 60 bristles per turn.

16. A brush in accordance with claim 1 wherein said bristles have a durometer of about 92 Shore D to about 120 Rockwell R.

* * * * *